US005435090A

United States Patent [19]

Darrow

[11] Patent Number: 5,435,090

[45] Date of Patent: Jul. 25, 1995

[54] FIREARM SECURING SNAP CAP

[76] Inventor: Jeffrey E. Darrow, R.D. #3, Box 127, Hollister Rd., Owego, N.Y. 13827

[21] Appl. No.: 209,587

[22] Filed: Mar. 14, 1994

[51] Int. Cl.[6] ..... F41A 29/00; F41A 17/44

[52] U.S. Cl. ..... 42/95; 42/70.11

[58] Field of Search ..... 42/70.11, 95, 96

[56] References Cited

U.S. PATENT DOCUMENTS

| | | | |
|---|---|---|---|
| 2,405,308 | 8/1946 | Jack | 434/19 |
| 2,763,081 | 9/1956 | Huckabee | 42/70.11 |
| 2,824,322 | 2/1958 | Angelica et al. | 15/104.09 |
| 3,848,350 | 11/1974 | Seminiano | 42/96 |
| 4,100,693 | 7/1978 | Cech | 42/96 |
| 4,503,578 | 3/1985 | McIntyre | 15/104.165 |
| 4,776,123 | 10/1988 | Ascroft | 42/70.11 |
| 4,843,750 | 7/1989 | Blase | 42/95 |

*Primary Examiner*—Charles T. Jordan

*Assistant Examiner*—Theresa M. Wesson

*Attorney, Agent, or Firm*—Salzman & Levy

[57] ABSTRACT

The present invention provides a simple and economical means for securing most firearms and consists of a unit body base used in conjunction with a conventional bore cleaning apparatus. The unit body base is designed to precisely fit firearm chamber dimensions with the rim circumference altered from standard ammunition casing profile. Consequently dry firing operation of the firearm can occur while maintaining a secured chamber. The unit body base is threaded to receive a bore cleaning apparatus oversized to the firearm chamber diameter, this provides mechanical resistance to manual removal of the device from the action or breech of the firearm. When the device is properly seated, live ammunition can not be readily chambered, so as to protect the firearm from unauthorized or unintentional discharge.

2 Claims, 3 Drawing Sheets

FIREARM SECURING SNAP CAP

FIELD OF THE INVENTION

The present invention relates to Firearm Securing Apparatus for gun owners and retailers, and more particularly, to a simplified apparatus that can be utilized to prohibit the unauthorized introduction of live ammunition into firearms present in the home or business.

BACKGROUND OF THE INVENTION

A firearm in the home increases a child's chance of death from accidental gunfire by 300 percent. Presently there are more than 200 million firearms in U.S. households. In fact, each year in the United States, 1,600 curious children are killed by household firearms. Thousands more are maimed or disfigured as a result of lax firearm storage safety practices.

Various devices for securing firearms are available.-.Unfortunately, most require the use of special tools or keys and are generally considered by owners and retailers cumbersome and inconvenient to use. Cost also limits the acceptability of devices currently available.

In addition to general firearm public safety concerns, firearm manufacturers recommend that the firing pin mechanism remain uncocked during storage. Storage in this manner promotes extended life of the firing pin spring. Releasing the firing pin to relax spring tension requires dry firing. Damage can occur to the firearm during dry firing if firing pin travel is not limited. Snap caps, available in standard gauges and calibers provide this function.

The introduction of a versatile device that provides a convenient and economical means of both safely securing and properly preparing a firearm for storage would be advantageous to gun owner and retainer.

The present invention seeks to achieve the above objectives.

SUMMARY OF THE INVENTION

The primary intended function of the present invention is to provide a simple and economical device for securing most gauges and calibers of firearms during sale and/or owner storage.

The Firearm Securing Snap Cap utilizes a bore cleaning brush attached to a unit body base that is sized to firearm chamber dimensions in accordance with ammunition casing tolerances. The rim profile of the unit body base incorporates a void that deviates from standard ammunition casing profile, permitting the device to remain seated in the firearm chamber, during ejector cycling. The securing snap cap is inserted in alignment with the ejector and seated in the firearm chamber preventing the subsequent introduction of live ammunition. The unit body base has a center core of resilient material designed to receive firing pin impact. In operation, the securing snap cap protects the firearm from dry fire damage. Removal of the securing snap cap is accomplished through the muzzle, utilizing a conventional bore cleaning rod.

Other advantages and features of the present invention will be evident by referring to the accompanying drawings, detailed description, and the appending claims.

BRIEF DESCRIPTION OF THE DRAWINGS

A complete understanding of the present invention may be obtained by reference to the accompanying drawings, when reviewed in conjunction with the detailed description thereof and in which.

DETAILED DESCRIPTION OF THE PREFERRED EMBODIMENT

Figure 2:
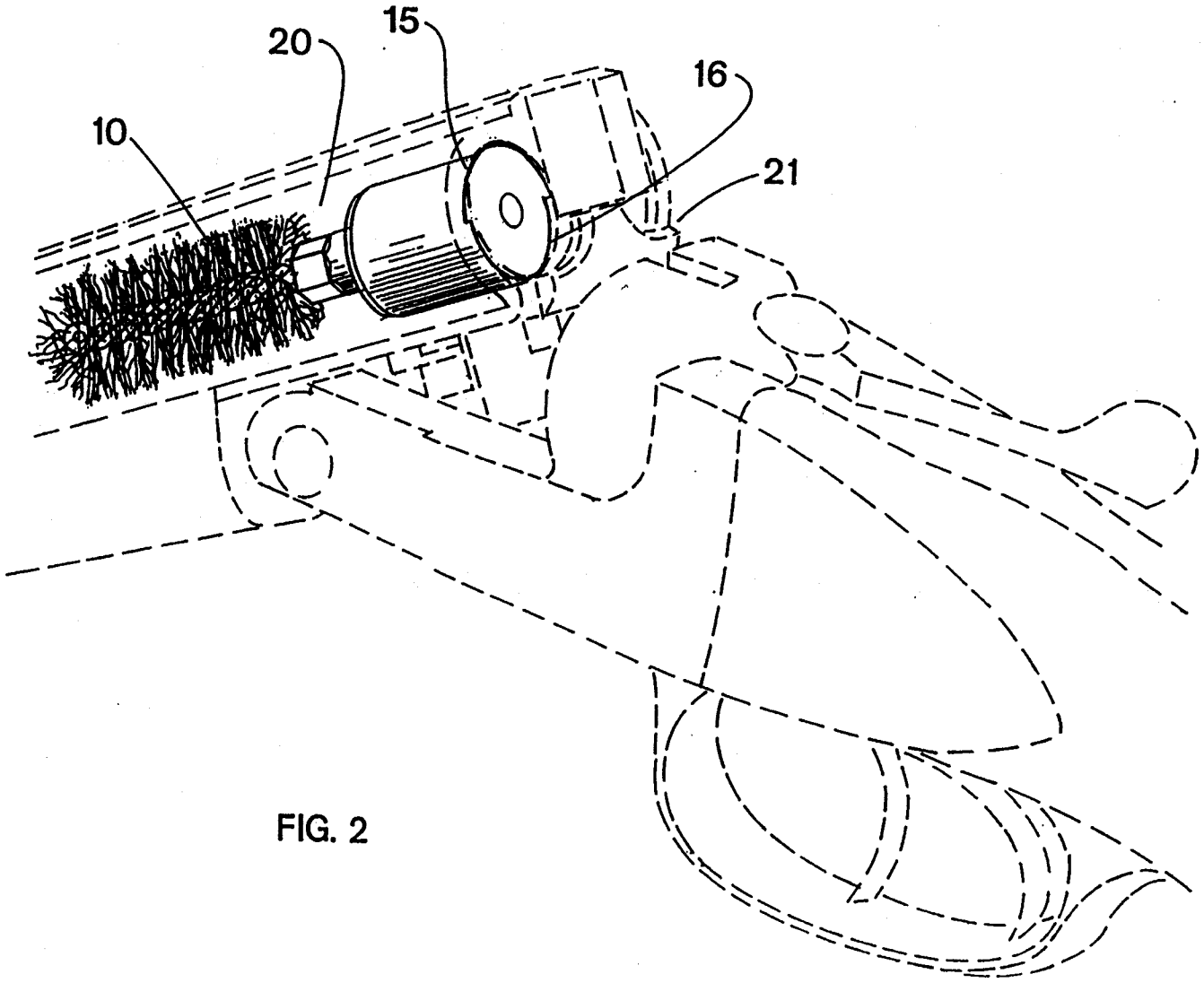
FIG. 2 illustrates a perspective view of a typical firearm chamber with the securing snap cap seated in a secured initial chambered position.

Generally speaking, the invention features an apparatus for securing most firearms, including shotgun, rifle and handgun, from unauthorized or unintentional chambering of live ammunition. The principal function is dependent upon, and comprised of, a standard firearm bore cleaning brush affixed to a precisely sized unit body base and, in operation, is inserted and seated in a firearm chamber. FIG. 2 illustrates the securing snap cap seated in a typical firearm chamber.

Now referring to FIGS. 1*a*, 1*b*, 1*c* and 1*d*, the securing snap cap is depicted generally as reference numeral 10. A unit body base 11, substantially cylindrical in shape, is precisely sized to firearm chamber dimensions and in accordance with applicable ammunition casing tolerances.

Figure 1A:
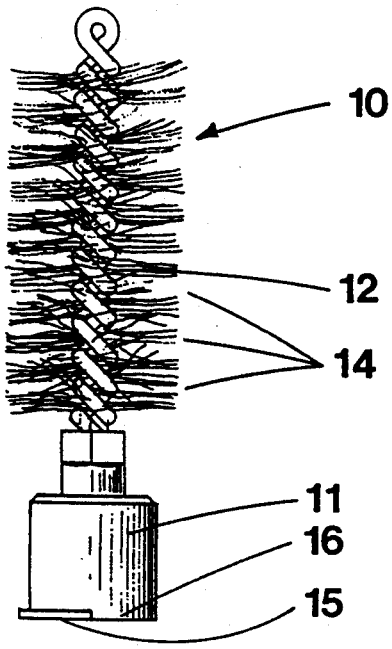
FIGS. 1*a*, 1*b*, 1*c* and 1*d* are, respectively, elevation, section, top and bottom views of a typical firearm securing snap cap representative of this invention.
Figure 1B:
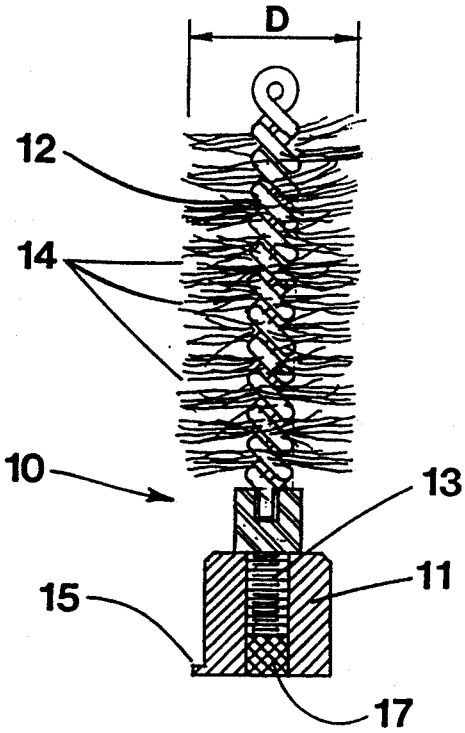

Attached to the unit body base 11 is a bore cleaning brush 12. The unit body base 11 is tapped and threaded to receive the threaded shaft 13 of the bore cleaning brush 12 as illustrated in FIG. 1*b*. The diameter "D" of the bore cleaning brush 12 is oversized to the firearm chamber inside diameter (not shown). The bore cleaning brush bristles 14 thereby provide mechanical resistance to manual removal of the seated securing snap cap 10 from the firearm chamber 20 shown in FIG. 2.

Figure 1C:
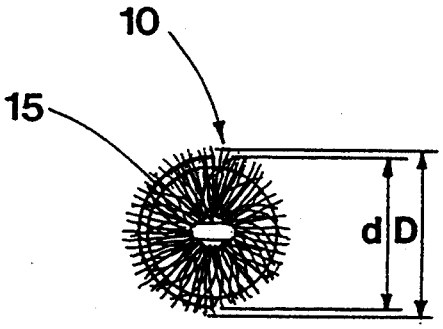

FIG. 1*c* further illustrates bore clean brush diameter "D" oversizing to the unit body base diameter "d".

The rim 15 of the unit body base 11 is partially interrupted or completely removed to correspond with specific firearm ejector (FIG. 2) configuration. The unit body base rim interruption 16 prevents firearm ejector 21 (FIG. 2) contact with the seated securing snap cap 10.

Figure 1D:
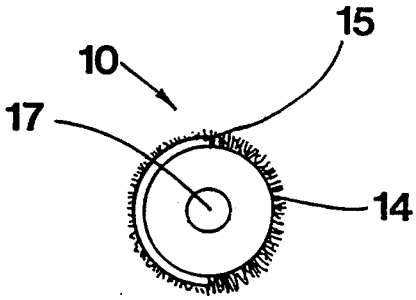

Referring now to FIGS. 1*b* and 1*d*, the bottom of the unit body base 11 has a resilient core 17 capable of withstanding and absorbing repeated impact energy from firing pin discharge. This feature protects the firing pin mechanism (not shown) from damage during firearm dry firing.

Figure 3:
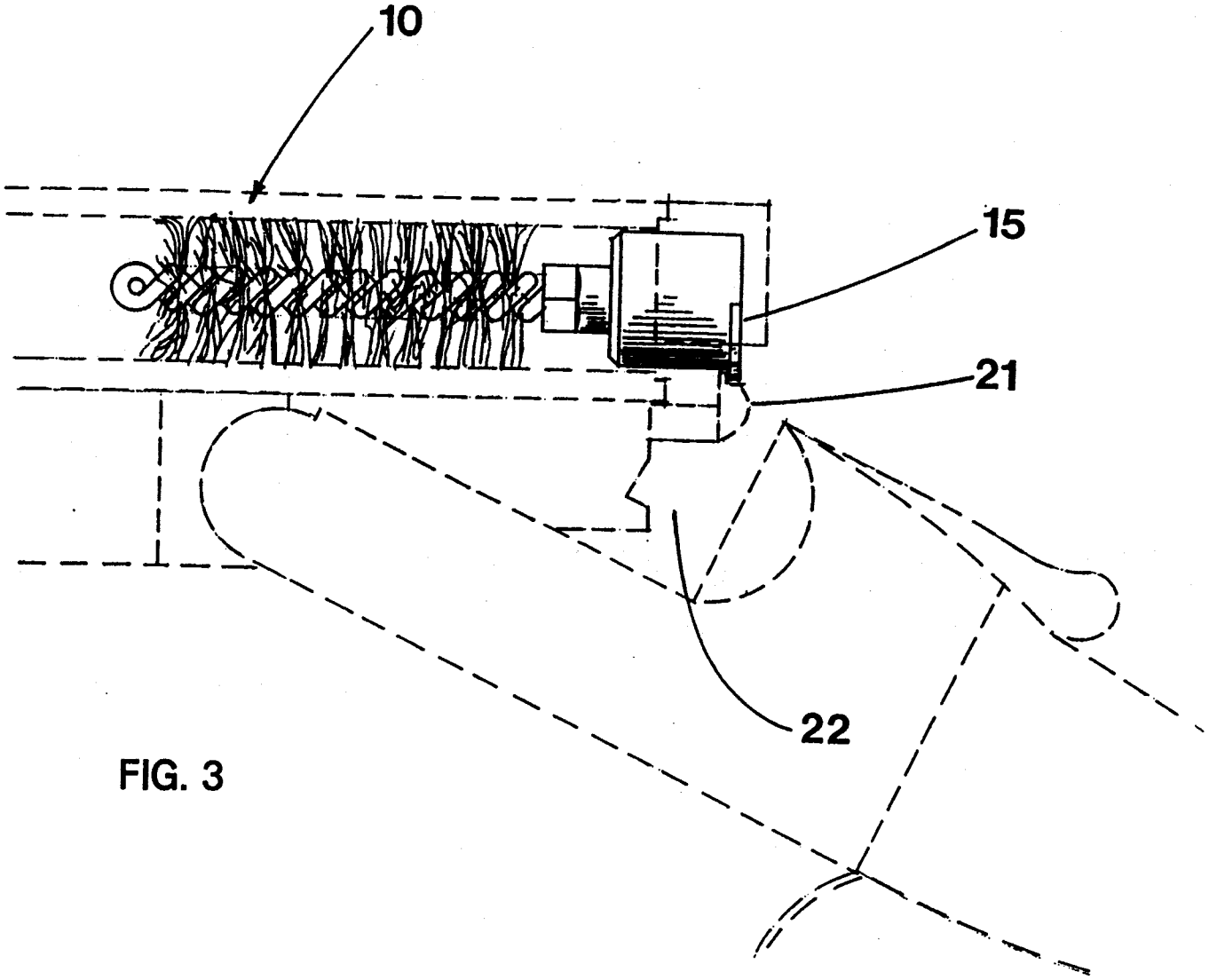
FIG. 3 is a sectional view of the securing snap cap depicted in FIG. 2 in a second chambered position.

The firearm securing snap cap 10 is operationally depicted in FIG. 2 and FIG. 3.

Referring to FIG. 2, the securing snap cap 10 is shown in a secured chamber position. The interruption 16 in the unit body base rim is aligned with the ejector 21 during installation and seating in the firearm chamber 20. In this position, ejector travel does not contact the unit body rim 15 and thereby allows the securing snap cap 10 to remain seated through dry fire cycling. In this position, removal is limited to forcing the securing snap cap 10 backwards out of its seated position with a bore cleaning rod, (not shown) inserted through the muzzle. The firearm is rendered secure from unauthorized use as described.

FIG. 3 illustrates the securing snap cap 10 positioned to permit manual removal from the firearm breech 22.

The unit body rim 15 is positioned during installation to allow contact with the ejector 21. Subsequently, each dry firing cycle raises the securing snap cap 10 from its seated position. This position permits use for dry fire protection only and is exclusive to shotgun ejector systems.

Since other modifications and changes may be varied to fit particular purposes and environments, as will be apparent to those skilled in the art, the invention is not considered to be limited to the specific embodiments chosen for the purpose of disclosure and covers all changes and modifications which do not constitute departure from the true spirit and scope of this invention.

Having thus described this invention, what is desired to be protected by LETTERS PATENT is presented by the subsequently appended claims.

What is claimed is:

1. A convenient and economical device for securing firearms from their unauthorized usage or unintentional discharge thereof, comprising:

a) a substantially cylindrical unit body base comprising thermoplastic resin, said unit body base fitting within a firearm chamber and sized to a diameter chosen from one of a specific plurality of firearm chamber diameters, said unit body base being sized in accordance with standard ammunition casing tolerances, said unit body base having a bottom portion and a top portion, said bottom portion having a rim with a circumferential profile interruption to prevent extraction by an ejector device and an energy-absorbing core section for receiving impact from and preventing damage to a firing pin of said firearm, said top portion being tapped and threaded to provide connection to a bore cleaning brush; and b) a bore cleaning brush, oversized to the chosen diameter of the firearm chamber, said bore cleaning brush being screwed into the top portion of said unit body base via said tapped and threaded top portion to form an integral unit, said cleaning brush having the dual purpose of both cleaning an inner wall of said firearm chamber and providing frictional resistance against extraction from said firearm chamber, whereby said unit body base is extractable by a cleaning rod inserted through a muzzle of said firearm.

2. A convenient and economical device for securing firearms from their unauthorized usage or unintentional discharge thereof, comprising:

a) a substantially cylindrical unit body base comprising a non-ferrous metal, said unit body base fitting within a firearm chamber and sized to a diameter chosen from one of a specific plurality of firearm chamber diameters, said unit body base being sized in accordance with standard ammunition casing tolerances, said unit body base having a bottom portion and a top portion, said bottom portion having a rim with a circumferential profile interruption to prevent extraction by an ejector device and an energy-absorbing core section for receiving impact from and preventing damage to a firing pin of said firearm, said top portion being tapped and threaded to provide connection to a bore cleaning brush; and b) a bore cleaning brush, oversized to the chosen diameter of the firearm chamber, said bore cleaning brush being screwed into the top portion of said unit body base via said tapped and threaded top portion to form an integral unit, said cleaning brush having the dual purpose of both cleaning an inner wall of said firearm chamber and providing frictional resistance against extraction from said firearm chamber, whereby said unit body base is extractable by a cleaning rod inserted through a muzzle of said firearm.

* * * * *